US006514160B1

(12) United States Patent
Cooper

(10) Patent No.: US 6,514,160 B1
(45) Date of Patent: Feb. 4, 2003

(54) BALL GAME

(76) Inventor: John M. Cooper, 3/287 Victoria Road, Thornbury Vic 3000 (AU)

( * ) Notice: Subject to any disclaimer, the term of this patent is extended or adjusted under 35 U.S.C. 154(b) by 0 days.

(21) Appl. No.: 09/554,222

(22) PCT Filed: Nov. 9, 1998

(86) PCT No.: PCT/AU98/00931

§ 371 (c)(1),
(2), (4) Date: Aug. 1, 2000

(87) PCT Pub. No.: WO99/24128

PCT Pub. Date: May 20, 1999

(30) Foreign Application Priority Data

Nov. 10, 1997 (AU) ..... PP0279

(51) Int. Cl.[7] ..... A63B 67/00; A63B 71/04
(52) U.S. Cl. ..... 473/415
(58) Field of Search ..... 473/415, 465; 472/90, 91, 92, 93, 94

(56) References Cited

U.S. PATENT DOCUMENTS 5,993,335 A * 11/1999 Edens et al. ..... 473/471
6,045,466 A * 4/2000 Suess ..... 473/470
6,193,233 B1 * 2/2001 Lipman ..... 273/138.1
6,200,234 B1 * 3/2001 Hannon ..... 473/471
6,336,876 B1 * 1/2002 Moore ..... 473/466
6,354,969 B1 * 3/2002 Sullivan ..... 473/502

FOREIGN PATENT DOCUMENTS

| | | |
|---|---|---|
| AU | 36630/84 | 12/1984 |
| GB | 2 272 231 A | 11/1994 |
| WO | 96/16708 | 6/1996 |

OTHER PUBLICATIONS

Web document, USA Team Handball, pp. 1–6 www.uateam-handball.org/abouthb.html, Aug. 1, 2001.*
Web document, IHF Rules, pp. 1–8 www.personal.mo-nash.edu.au/~lipcsey/hndball/rules/IHF–olympic.html, Aug. 1, 1997.*

* cited by examiner

*Primary Examiner*—Sebastiano Passaniti
*Assistant Examiner*—M. Chambers

(57) ABSTRACT

A method of playing soccer on a reduced size playing area with a plurality of zones. A spherical ball is provided as is a netted goal and an upper boundary surface. Two opposing teams consisting of one or more players commence the game by kicking said spherical ball from one of the provided serve boxes against the serve wall, the said spherical ball coming into general play on landing in the opponents serve area, the game then being played under the general rules of soccer until a prescribed goal score is achieved, a prescribed goal score difference is achieved and/or a prescribed period of time expires.

9 Claims, 1 Drawing Sheet

BALL GAME

This invention relates to a ball game and refers particularly although not exclusively, to a ball game adapted to be played on a court which may be indoors or outdoors.

BACKGROUND OF THE INVENTION

The game of soccer originated in England many years ago. It developed from a hurley-burley game played through the streets of a village with teams of any number, to the modern game which is the most popular sport in the world. The popularity of soccer has reached the stage that the final of the World Cup is watched by more people than would watch the most spectacular events of the Olympic Games. Television audiences of in excess of 600,000,000 people are not unexpected for such events.

the problem with soccer is that it is generally considered a winter sport. It must be played on a playing field using teams of eleven players. For recreational players, quite often it is not possible to have sufficient people in each team to field a full team. Furthermore, access to the appropriate playing field (which may be level or otherwise) may be difficult. Also, they may not have the desire to play the game in inclement weather or adverse conditions.

It is therefore the principal object of the present invention to provide a game similar to soccer and which can be played on a court which may be indoors or outdoors.

A further object of the present invention is to provide a ball game similar to soccer and which can be played by two players.

Yet another object of the present invention is to provide a court on which such a game can be played.

SUMMARY OF THE INVENTION

With the above and other objects in mind the present invention provides a court for playing a ball game, the court having a service wall parallel to and opposite the service wall, two spaced-apart and parallel side walls extending between the service wall and the goal wall, and a floor extending between the four walls; the four walls being mutually perpendicular, the floor being divided into a plurality of zones including a goal zone, at least one service box, at least one attack zone, and a strike zone.

Preferably, there is provided a goal on or adjacent the goal wall. More preferably the goal zone extends outwardly from the goal and for the full width of the goal. Advantageously, the service wall has a legal service area and non-legal service area. Preferably, the attack zone extends for the full width of the floor from the goal wall for more than half of the length of the floor. More preferably, the strike zone is betwen the attack zone and the service wall.

It is preferred there be provided service line extending across the floor between the two side walls. Preferably, the service box is between the service line and the goal wall. More preferably, there is a service box on each side of the floor, at the intersection of the service line and the side wall.

It is preferred that there be a longitudinally extended line along the centre of the floor extending from the centre of the goal to the end of the attack zone adjacent the service wall.

the invention also provides a game, wherein the game commences by a kick-off from a service box, the game using a spherical ball, the kick-off being legal if initial contact with a service wall is on or below a service line, and first contact with a floor is in an opponent's attack zone, the game being played under rules similar to those of soccer until: a period of time expires, a prescribed goal score is achieved, and/or a prescribed goal-score difference is achieved.

Preferably, there in no out-of-play.

More preferably, in the event of a penalty kick or free kick, the opponent must stand with heels adjacent the goal line, and cannot move until the penalty kick takes place.

Advantageously, there is a goal zone which is a player exclusion zone.

More advantageously, a deliberate "hand ball"may result in a penalty kick no matter where on the court the offence occurred.

Preferably, off-side occurs when a player plays the ball from the strike zone to attempt a headed goal from the attack zone but is goalside of an opponent when initially playing the ball.

A goal may be secured on kick-off, or by kick from the strike zone, or by an on-side header from anywhere except the goal zone, or from a free kick or penalty kick.

At kick-off, or service, the opponent of the server should be in the attack zone behind the service line.

BRIEF DESCRIPTION OF DRAWING

In order that the invention may be fully understood there shall now be described by way of non-limitative example only a preferred construction of a court for playing a ball game, as well as a ball game, in acordance with the present invention, the description being with reference to the accompanying illustrative drawing which is a perspective view from above of a court in accordance with the present invention.

DESCRIPTION OF PREFERRED EMBODIMENT

Figure 1:
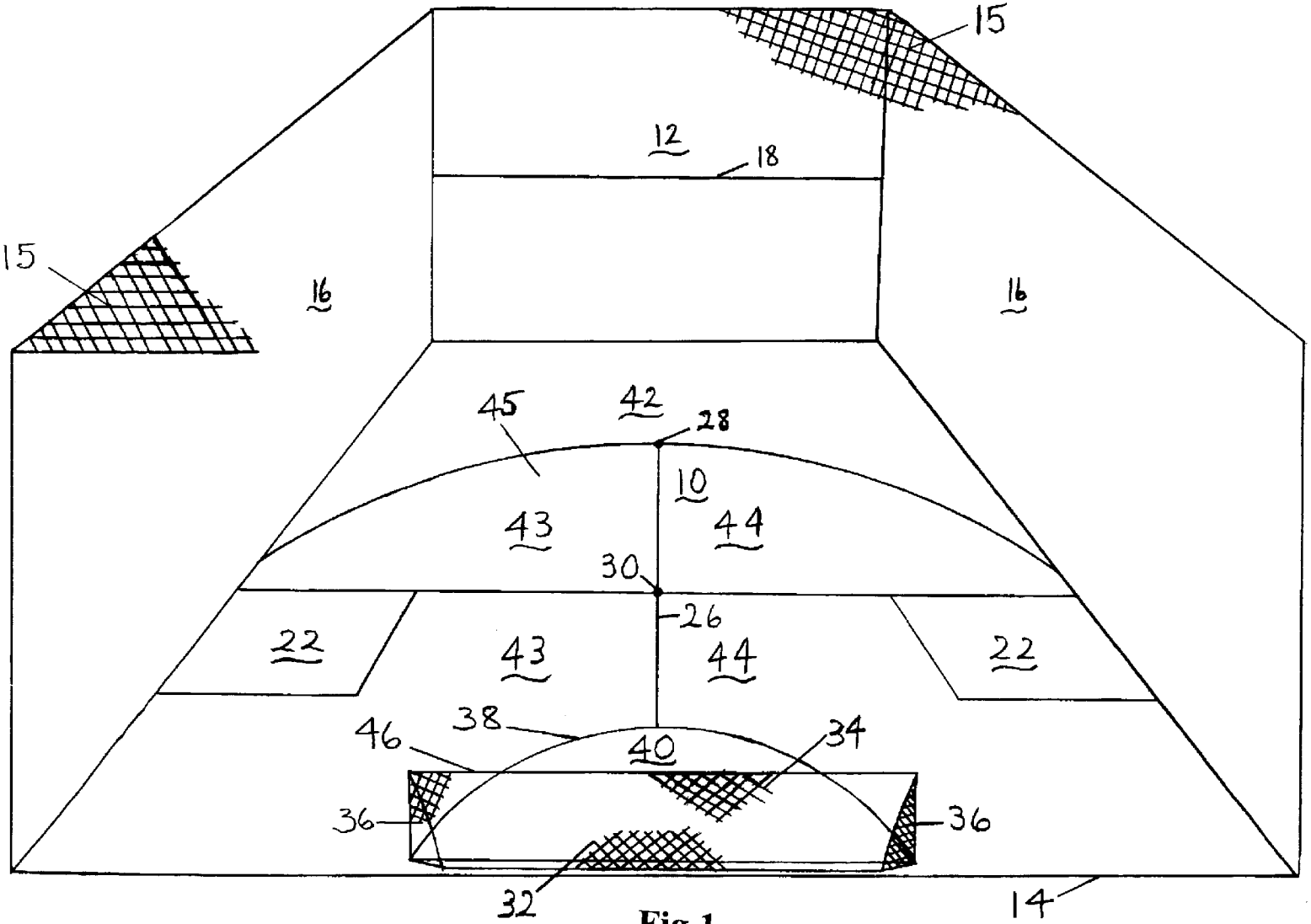

To refer to the drawing there is shown a court which has a floor 10, a service wall 12, a goal wall 14, and two identical and parallel side walls 16 extending along the length of the floor 10 from the service wall 12 to the goal wall 14. A roof o ceiling of any suitable material may also be provided, if desired.

Extending across the service wall 12 at approximately the mid point of its height is a service wall line 18. The purpose of the service wall line 18 is so that any serve (or kick off) which lands above the line 18 will be considered an illegal serve. Any serve landing on or below the line 18 will be considered a legal serve. That area below the service wall line 18 is the legal service area, and that above the service line 18 is the illegal service area. If the serve or kick-off is illegal, the right of service passes to the other player.

Extending across the floor 10 between the side walls 16 is a service line 20. This is approximately in the middle of the floor 10 between the walls 12, 14, although it need not be exactly central, and as long it is in the central region it is satisfactory. For example, it may be in the range of between 40 to 60% along the floor. Extending towards the goal wall 14 from the service line 20, and adjacent each side wall 16, is a service box 22. These are substantially identical.

Extending in an arc from one wall 16 to the opposite wall 16 between the service line 20 and the service wall 12 is a strike zone boundary line 24. Also extending longitudinally is a dividing line 26 which extends from the goal wall through to the strike zone boundary line 24. The dividing line 26 is along the central axis line of the floor 10 and divides the floor 10 up to boundary line 24 into two substantially equal portions. At the junction of the dividing line 26 with the strike zone line 24 is a free kick spot 28. At the junction of the service line 20 and the dividing line 26 is a penalty spot 30.

Mounted on the floor 10 against or adjacent the wall 14 is a goal 32. The goal is designed so that any ball contacting on its top 34 or contacting a side 36 will rebound or fall into play. Although the goal may be of any suitable size, it is preferably of a sufficient size that the scoring of a goal is not overly easy, nor excessively difficult. It is preferred that it be less than a meter high, and less than three meters wide. Dimensions such as 850 mm high, and 2.4 meters wide are preferred. Extending in front of the goal 32 is a goal zone line 38 creating a goal zone 40.

Between the strike zone line 24 and the service wall 12 is a strike zone 42. Between the strike zone line 24 and the goal wall 14, but excluding the goal zone 40, is the attack zone 45, having the two service areas 43, 44, each of which has a service box 22. One attack zone 43 is on one side of the dividing line 26 and the other attack zone 44 is on the other side of the dividing line 26.

In playing the game, a ball somewhat similar to a soccer ball may be used. However, it is preferred that the ball be somewhat smaller, given the smaller area in which the game is played. Furthermore, in view of the size of the area, it is preferred that the ball be somewhat softer than a normal soccer ball. For example, a beach volleyball, or similar ball, or even a ball of slightly smaller size, may be used. It is preferred that the ball be able to swerve as does a soccer ball, be able to be headed, yet not be so hard that it would cause significant injury to a person if accidentally struck. it must have the ability to rebound from the walls with minimal loss of energy. The ball may be solid, or inflated, as required.

In playing the game, only two people are required to play, although teams of greater number may be used. After an appropriate means for selecting the person to commence the game, that person selects the service box 22 in which they wish to commence. The ball is placed on the floor 10 within that box 22. Their opponent must be located in their service area 43 or 44, depending upon in which service box 22 the server is to be commencing the game.

At commencement, the person serving kicks the ball from the box 22 against the wall 12. It must strike on or below the service wall line 18 to be legal. If it strikes above line 18 it is not a legal serve and a second serving attempt must take place. If that second serving attempt is not legal, the right of service passes to the other player. If the service is to be initially legal, it must contact the floor 10 across dividing line 26 and thus be in the service area 43, 44 of the opponent. It cannot initially land in the strike zone 42 nor in the goal zone 40. At the time of kick-off (serve), the opponent must be in the attack zone 45 behind the service line 20 on the other side of dividing line 26.

Upon a serve being legal, each player can play the ball as would be normal in soccer. The ball will remain in play until either a free kick, penalty, or a goal is awarded. There is preferably no out of play area. With that in mind netting, or a solid roof or ceiling, or the like, may be provided around or over any part of the court where the ball may otherwise have gone out of lay. The ball will therefore be kept in play. During normal play the server can tackle the opponent as is allowed under the rules of soccer. Each player will attempt to score a goal. A goal can be scored from kick-off; or by being kicked from the strike zone. A goal may also be scored by being headed, preferably from an on-side position, within the strike zone or attack zone or from a free kick or penalty kick. The goal zone is an exclusion zone and a player is not allowed into the goal zone during the normal course of play.

In a smiliar fashion to soccer, a player is off-side when they play the ball from the strike zone to attempt a headed goal from the attack zone but are goalside of their opponent when they initially play the ball.

A goal is scored when the ball is over the goal line. The preferred percentage of the ball over the line for a goal to be scored is 100%. However, a lesser figure such as, for example, 50% may be used. The goal line is the line on the floor 10 immediately under the top bar 46 of goal 32.

As is stated above, a goal may be scored from the strike zone 42, or through an on-side headed attempt anywhere other than inside the goal zone 40, from a free kick or penalty kick when either is awarded, or from the serve, directly or indirectly, provided compliance with the above rules is made, or against ones self (own goal) if from anywhere on the court except the strike zone.

As in the game of soccer, a deliberate touching of the ball with a hand or arm is an offence. However, in this instance a penalty kick is awarded irrespective of where in the court the offence occurs. In the event of a penalty kick being awarded, the defending player must position themselves no more than ten centimeters from the goal line (with a heel to the line) and must not move their feet until the ball is struck. The ball is placed on the penalty spot 30.

In a like manner to soccer, a free kick may be awarded for appropriately unsatisfactory conduct, or a general foul such as a late tackle, excessively hard tackle, and so forth. In that instance the ball is placed on the free kick spot 28 and the defender must be located as per the above description for a penalty kick.

The goal zone 40 is an exclusion zone during normal play. A player who enters the goal zone 40 and blocks or attempts to block a goal attempt by their opponent is penalized by a penalty kick to the opponent. A player who enters a goal zone other than to block or attempt to block a goal attempt by their opponent is penalised by a free kick to their opponent.

Upon a goal being scored, the opponent of the goal scorer then has the right to service (kick off).

A game may be divided into a number of periods which may be of any suitable duration such as, for example, 10 minutes. A two minute time out is allowed per player per game. Alternatively or additionally, the game and/or a period of the game may conclude when a prescribed goal score, and/or a prescribed goal-score differential, is achieved. If desired, a "shot clock" can be provided to force a player to attempt to score within a defined period (eg 30 seconds) and to prevent excessive time wasting. Standard blood rules would apply.

Whilst there has been described in the foregoing description a preferred embodiment of the present invention, it will be understood by those skilled in the industry concerned that many variations or modifications in these specific details may be made without departing from the essential features of the invention.

It will also be understood that where the term "comprises" or its grammatical variants, is employed herein, it is equivalent to the term "includes" and is not to be taken as excluding the presence of other elements or features.

What is claimed is:

1. A method of playing soccer on a reduced size playing area, comprising the steps of:

a) providing a generally square or rectangular playing area having (i) a goal wall parallel to and opposite a serve wall defining a length of said playing area, (ii) opposing side walls defining a width of said playing area, (iii) a floor between said four walls being divided into a plurality of zones including (a) a goal zone extending outwardly from the goal and for the full width of the goal, (b) an attack zone which extends for the full width of the floor from the goal wall to the strike zone, (c) a strike zone wherein said strike zone is between the attack zone and the serve wall, (d) two serve areas wherein each of said serve areas extend from the goal wall to the strike zone for half the width of said playing area and separated by a central longitudinally extended line, (e) two serve boxes wherein each serve box is located on opposing sides of the floor at the intersection of the serve line and the side wall toward the goal wall end;

b) providing a generally spherical ball;

c) providing a netted goal adjacent the goal wall such that said netted goal defines a scoring area elevated above said playing area floor including a goal line between the two parallel and perpendicular posts of said netted goal and directly below the crossbar of said netted goal.

2. The method of playing soccer of claim 1 also comprising the steps of:

1) providing two opposing teams, each team consisting of at least one player, having as an objective to move said spherical ball across said goal line into said netted goal by kicking or heading said spherical ball; a legal goal being scored if kicked either (i) from serve/kick-off, (ii) from the said strike zone, (iii) from a free kick or penalty kick, or if headed (iv) from the said strike zone or (v) from anywhere on said playing area excluding said goal zone provided that the opposing player is goal-side of the player heading the ball when said player initially plays the ball to his/her head;

b) providing a penalty kick spot on the central point of said serve line;

c) Providing a free kick spot on the central point of the arc of the line dividing said attack and strike zones;

d) providing an upper boundary surface comprising a net or ceiling extending the full length and width of said playing area.

3. The method of playing soccer of claim 1 wherein the game commences when said spherical ball is kicked from a team serve box and if initial contact with the serve wall is on or below said serve wall line and first contact with the floor is in the opponent's serve area, the game then being played under the general rules of soccer until (a) a prescribed goal score is achieved;

(b) a prescribed goal score difference is achieved and/or (c) a prescribed period of time expires.

4. The method of playing soccer of claim 1 wherein said goal zone is a player exclusion zone except in the instance of a penalty or free kick.

5. the method of playing soccer of claim 1 wherein in the event of a penalty or free kick the defending player must stand with heels adjacent said goal line not more than a specified distance from said goal line and must not move from said position until the penalty or free kick is struck.

6. The method of playing soccer of claim 5 wherein the specified distance is less than or equal to 25 centimeters.

7. The method of playing soccer of claim 1 wherein at serve/kick-off the opponent is located within his/her said serve area and behind said serve line.

8. The method of playing soccer of claim 1 wherein a goal may be be scored for the other team if said goal is scored thorugh a player's contact with the sperical ball, directly or indirectly, from anywhere on said playing area outside the said strike zone with the exception of a headed goal.

9. A method of playing soccer on a reduced size playing area which is a generally square or rectangular playing area having (i) a goal wall parallel to and opposite a serve wall defining a length of said playing area, (ii) opposing side walls defining a width of said palying area, (iii) a floor between said four walls being divided into a plurality of zones including (a) a goal zone extending outwardly from the goal and for the full width of the goal, (b) an attack zone which extends for the full width of the floor from the goal wall to the strike zone, (c) a strike zone wherein said strike zone is between the attack zone and the serve wall, (d) two serve areas wherein each of said serve areas extend from the goal wall to the strike zone for half the width of said playing area and separated by a central longitudinally extended line, (e) two serve boxes wherein each serve box is located on opposing sides of the floor at the intersection of the serve line and the side wall toward the goal goal wall end;

wherein;

the game utilizes a generally spherical ball and there is a netted goal adjacent the goal wall such taht said netted goal defines a scoring area elevated above said playing area floor including a goal line between the two parallel and perpendicular posts of said netted goal and directly below the crossbar of said netted goal;

two opposing teams, each consisting of at least one player, having as an objective to move said spherical ball across said goal line into said netted goal be kicking or heading said spherical ball, wherein a legal goal being scored if kicked either (i) from serve/kick-off, (ii) from the said strike zone, (iii) from a free kick or penalty kick, or if headed (iv) from said strike zone or (v) from anywhere on said playing area excluding said goal zone provided that the opposing player is goalside of the player heading the ball when said player initially plays the ball to his/her head;

wherein;

a penalty kick spot is provided on the central point of said serve line;

a free kick spot is provided on the central point of the arc of the line dividing said attack and strike zones;

an upper boundary surface is provided comprising a net or ceiling extending the full length and width of said playing area;

the game commencing when said spherical ball is kicked from either of said serve boxes and if initial contact with the serve wall is on or below said serve wall line and first contact with the floor is in the opponents serve area, the game is then played under the general rules of soccer until (a) a prescribed goal score is schieved, (b) a prescribed goal score difference is acchieved and/or (c) a prescribed period of time expires;

said goal zone is a player exclusion zone except in the instance of a penalty kick; in the event of a penalty kick the defending player must stand with heels adjacent said goal line not more than 25 cm from said goal line and must not move from said position until the penalty or free kick is struck; at serve/kick-off the opponent must be located within his/her serve area and behind said serve line;

wherein a goal may be scored for the other team if said goal is scored through a player's contact with said spherical ball, directly or indirectly, form anywhere on said playing area outside said strike zone with the exception of a headed goal.

* * * * *